US011371370B2

(12) United States Patent
Hoeger et al.

(10) Patent No.: US 11,371,370 B2
(45) Date of Patent: Jun. 28, 2022

(54) FLOW ARRANGEMENT FOR PLACING IN A HOT GAS DUCT OF A TURBOMACHINE

(71) Applicant: MTU Aero Engines AG, Munich (DE)

(72) Inventors: Martin Hoeger, Erding (DE); Fadi Maatouk, Munich (DE); Guenter Ramm, Eichenau (DE); Yavuz Guendogdu, Munich (DE); Irene Raab, Munich (DE)

(73) Assignee: MTU Aero Engines AG, Munich (DE)

( * ) Notice: Subject to any disclaimer, the term of this patent is extended or adjusted under 35 U.S.C. 154(b) by 509 days.

(21) Appl. No.: 16/037,056

(22) Filed: Jul. 17, 2018

(65) Prior Publication Data

US 2019/0024521 A1 Jan. 24, 2019

(30) Foreign Application Priority Data

Jul. 19, 2017 (DE) ..... 10 2017 212 311.7

(51) Int. Cl.
*F01D 9/04* (2006.01)
*F01D 9/06* (2006.01)
*F01D 5/14* (2006.01)

(52) U.S. Cl.
CPC ..... *F01D 9/041* (2013.01); *F01D 5/142* (2013.01); *F01D 9/065* (2013.01); (Continued)

(58) Field of Classification Search
CPC ..... F01D 9/041; F01D 5/142; F01D 9/065; F05D 2220/323; F05D 2240/121; F05D 2240/122; F05D 2240/128; F05D 2250/34
See application file for complete search history.

(56) References Cited

U.S. PATENT DOCUMENTS 2,888,803 A 6/1959 Pon
2,941,781 A 6/1960 Boyum
(Continued)

FOREIGN PATENT DOCUMENTS

DE 2741063 A1 3/1979
DE 3306298 A1 9/1983
(Continued)

*Primary Examiner* — Eric J Zamora Alvarez
(74) *Attorney, Agent, or Firm* — Barlow, Josephs & Holmes, Ltd.; David R. Josephs

(57) ABSTRACT

The invention relates to a flow arrangement for placing in the hot gas duct of a turbomachine, having a first surrounding-flow structure and a second surrounding-flow structure, the surrounding-flow structures each having, in reference to the surrounding flow in the hot gas duct, a leading edge and, downstream thereof, a trailing edge, wherein the second surrounding-flow structure is provided as a deflecting blade with a suction side and a pressure side and has a lesser profile thickness than the first surrounding-flow structure, which is arranged on the suction side of the second surrounding-flow structure, and wherein, although the second surrounding-flow structure has a partial axial overlap with the first surrounding-flow structure referred to a longitudinal axis of the turbomachine, the trailing edge of the second surrounding-flow structure is, at the same time, displaced axially downstream relative to the trailing edge of the first surrounding-flow structure.

11 Claims, 3 Drawing Sheets

(52) U.S. Cl.
CPC .. *F05D 2220/323* (2013.01); *F05D 2240/121* (2013.01); *F05D 2240/122* (2013.01); *F05D 2240/128* (2013.01); *F05D 2250/34* (2013.01)

(56) References Cited

U.S. PATENT DOCUMENTS

| | | | |
|---|---|---|---|
| 3,039,736 | A | 6/1962 | Pon |
| 3,704,075 | A | 11/1972 | Karstensen et al. |
| 4,989,406 | A | 2/1991 | Vdoviak et al. |
| 9,556,746 | B2 | 1/2017 | Paradis et al. |
| 2010/0132376 | A1 | 6/2010 | Durocher et al. |
| 2010/0272566 | A1 | 10/2010 | Durocher et al. |
| 2013/0051996 | A1 | 2/2013 | Hoeger et al. |
| 2013/0170969 | A1 | 7/2013 | Subramaniyan et al. |
| 2013/0330180 | A1 | 12/2013 | Guendogdu et al. |
| 2014/0328675 | A1 | 11/2014 | Derclaye et al. |
| 2015/0044032 | A1 | 2/2015 | Paradis et al. |
| 2015/0260103 | A1 | 9/2015 | Yu et al. |
| 2017/0022832 | A1 | 1/2017 | Tsifourdaris et al. |
| 2017/0022835 | A1* | 1/2017 | Clark ..... F01D 9/041 |

FOREIGN PATENT DOCUMENTS

| | | | |
|---|---|---|---|
| DE | 3810600 | C2 | 3/2001 |
| DE | 60112824 | T2 | 3/2006 |
| DE | 102004036594 | A1 | 3/2006 |
| DE | 102012215413 | A1 | 3/2014 |
| EP | 1122407 | A2 | 8/2001 |
| EP | 2256299 | A2 | 1/2010 |
| EP | 2703604 | A1 | 3/2014 |
| EP | 2775098 | A2 | 9/2014 |
| EP | 2835503 | A1 | 2/2015 |
| EP | 2860354 | A1 | 4/2015 |
| EP | 3121383 | A1 | 1/2017 |
| GB | 476222 | A | 12/1937 |
| GB | 1058759 | A | 2/1967 |
| GB | 1534124 | A | 11/1978 |
| JP | 2003206702 | A | 7/2003 |
| JP | 2009215897 | A | 9/2009 |
| WO | 2014105688 | A1 | 7/2014 |
| WO | 2017015743 | A1 | 2/2017 |

* cited by examiner

FLOW ARRANGEMENT FOR PLACING IN A HOT GAS DUCT OF A TURBOMACHINE

BACKGROUND OF THE INVENTION

The present invention relates to a flow arrangement with surrounding-flow structures for placing in a hot gas duct of a turbomachine.

The turbomachine can be, for example, a jet engine, such as, for example, a turbofan engine. In functional terms, the turbomachine is subdivided into a compressor, a combustion chamber, and a turbine. In the case of a jet engine, for instance, sucked-in air is compressed by the compressor and combusted with admixed kerosene in the downstream combustion chamber. The resulting hot gas, which is a mixture of combustion gas and air, flows through the downstream turbine and is thereby expanded. The volume through which the hot gas flows, that is, the path from the combustion chamber via the turbine to the nozzle, is referred to as the "hot gas duct."

The flow arrangement addressed here is provided for arrangement in the hot gas duct and has a plurality of surrounding-flow structures. At least some of the surrounding-flow structures are designed as deflecting blades; other surrounding-flow structures are preferably support struts or corresponding claddings. Like the preceding reference to a jet engine, these are intended to illustrate the present subject, but first and foremost not to limit it in terms of generality. The turbomachine can also be, for example, a stationary gas turbine or steam turbine.

SUMMARY OF THE INVENTION

The present invention is based on the technical problem of presenting an especially advantageous flow arrangement for placing in the hot gas duct of a turbomachine.

In accordance with the invention, this object is achieved by the flow arrangement of the present invention. The flow arrangement has a first surrounding-flow structure and a second surrounding-flow structure, wherein the second surrounding-flow structure is provided as a deflecting blade and has a lesser profile thickness than the first surrounding flow structure, which is arranged at the suction end of the second surrounding-flow structure. Furthermore, although the surrounding-flow structures are arranged with a partial axial overlap, the trailing edge of the second surrounding-flow structure is, at the same time, displaced downstream of the trailing edge of the first surrounding-flow structure. In figurative terms, initially different surrounding-flow structures, which, in a conventional construction, are provided in separate segments that axially follow one another, are pushed into one another to a certain extent (axial overlap), but not fully, by way of the present flow arrangement.

By displacing backward the trailing edge of the second surrounding-flow structure (referred to hereinafter also as the "thin deflecting blade"), it is possible to produce a suction at the trailing edge of the first surrounding-flow structure (referred to hereinafter also as the "thick blade"). Accordingly, the flow from the trailing edge of the aerodynamically more unfavorable thick blade can be accelerated away and the trailing flow can be refined or made uniform, which reduces detrimental secondary flows, for example, and can also have a noise-reducing effect. In figurative terms, the thin deflecting blade brings about a load relief and a smooth flow off the trailing edge of the thick blade (Kutta condition). In regard to the uniformity of the flow to the downstream rotor, this can be of advantage or also help to improve the efficiency of the turbine overall by approximately 0.25% to 0.5%, for example.

Preferred embodiments are presented in the dependent claims and in the entire description, without a distinction always being made in detail in the presentation of the features between the flow arrangement and a corresponding turbomachine or uses associated therewith. Implicitly, in any case, the disclosure is to be read as relating to all claim categories.

Each of the surrounding-flow structures has a leading edge and a trailing edge, between which two mutually opposite lateral surfaces of the respective surrounding-flow structures extend in each case. The profile thickness is constituted between the lateral surfaces. In detail, the mean line between the leading edge and the trailing edge of the respective surrounding-flow structure extends in the middle between the lateral surfaces in each case and the profile thickness then results as the largest circle diameter on the mean line (the circle touches the lateral surfaces and the center point lies on the mean line). The thin deflecting blade can have, for example, a profile thickness that is reduced by at least 50%, 60%, 70%, or 80% in comparison to the first surrounding-flow structure, with possible upper limits (independent thereof) of, for example, at most 99%, 97%, and 95% (respectively, increasingly preferred in the named sequence).

Insofar as, in general, in the scope of this disclosure, different structures are compared with one another, such as, for instance, the surrounding-flow structures are compared with one another or also with other blades of the turbine (see below), the basis is the design of the respective structure in its respective radial middle. What is regarded in each case, therefore, is the shape at half height (viewed radially) of the corresponding surrounding-flow structure or of the deflecting blade or of the blade element. The influence on the flow can be greatest at the radial middle of the gas duct. Preferably, however, the respective structures are nevertheless designed correspondingly in relation to one another over their entire height (at any rate, in a comparison at the same percent height in each case).

In general, in the scope of this disclosure, "axially" refers to the longitudinal axis of the turbomachine, which, for example, coincides with an axis of rotation of the rotors. "Radially" refers to the radial directions that are perpendicular to and point away from the axis of rotation, and a "rotation" or "rotationally" or the "direction of rotation" relates to the rotation around the longitudinal axis. The first surrounding-flow structure and the second surrounding-flow structure are arranged following each other—for example, on account of the axial overlap—also in the direction of rotation. In other words, "axial" overlap means, for example, that a projection of the first surrounding-flow structure radially onto the longitudinal axis has an overlap with a projection of the second surrounding-flow structure radially onto the longitudinal axis.

In the scope of this disclosure, "a" and "an" are to be read as indefinite article and hence are always to be read as "at least one." Via a full rotation around the longitudinal axis, the flow arrangement can therefore have a plurality of first and second surrounding-flow structures in each case, such as, for example, at least 4, 5, or 6, with possible upper limits (independent thereof) of, for example, at most 30, 20, or 15. In each case, the first surrounding-flow structures and the second surrounding-flow structures are then arranged preferably with identical constructions and with rotational symmetry. As is made clear below in detail, there can also be third and, under certain circumstances, fourth or even more surrounding-flow structures, which can then likewise be designed as thin deflecting blades. Therefore, for example, at least two and preferably no more than nine, eight, seven, six, five, four, or three thin deflecting blades can be provided rotationally between two thick blades in each case.

In one preferred embodiment, the first surrounding-flow structure is provided as a bearing support strut or as a cladding, in particular as a cladding of a bearing support strut. The support strut is a bearing component of the turbomachine and, together with further support struts that are arranged rotationally, it preferably carries the bearing of the turbine shaft, in particular the high-pressure turbine shaft. The bearing is preferably arranged in the turbine center frame, that is, in the so-called mid turbine frame. The support struts can each extend radially outward away from the bearing and the bearing is thus held centered in the housing in a more or less spokelike manner.

Preferably, the first surrounding-flow structure is a cladding, in which it is also possible to convey a supply line, for example, and which is preferably a cladding of a support strut and, for aerodynamic reasons, is therefore attached to the actual bearing component. In this case also, additional supply lines, etc. can then be conveyed as well. Such a cladding is also referred to as a fairing. The bearing function or the enclosure of the support strut necessitates a certain structural size, that is, a large profile thickness. This is an aerodynamic drawback, which, however, is compensated for at least in part by the combination with the thin deflecting blade.

In general, the first surrounding-flow structure can also be provided so as to be non-deflecting; preferably, it is weakly deflecting at only 5°, but has no effect on the flow (as a consequence of the change in radius and the principle of angular momentum, no impulse is transmitted to the flow). With its bottom surface, the first surrounding-flow structure (thick blade) faces the thin deflecting blade. More deflection is necessary at the bottom side of the thick blade, because, as a consequence of the greater thickness, its bottom side extends axially into the trailing edge—for example, it is inclined by no more than 10° or 5° with respect to the axial direction. At the trailing edge of the thick blade, the thin deflecting blade produces, for one thing, an acceleration (nozzle effect). Furthermore, the trailing flow is "sucked away" from the trailing edge.

In one preferred embodiment, the thin deflecting blade has its maximum curvature at the place where it has the axial overlap with the first surrounding-flow structure. This design with a strong curvature is comparable to a support surface with extended Fowler flap, which further increases the suction produced at the trailing edge of the thick blade.

In one preferred embodiment, the trailing edge of the thin deflecting blade is displaced by at least 0.5 times, further and especially preferably at least 0.7 or 0.9 times, the axial length of the blading of a downstream directly following rotor with respect to the trailing edge of the first surrounding-flow structure (axially downstream). Preferred upper limits, which, in general, can also be independent of the lower limits of interest, lie at most at 4 times, further and especially preferred at most at 2.6 or 2.2 times, the axial length. The "axial length" is obtained as the axial fraction of the chord length of the rotating blades of the rotor (if the rotor is equipped with different blades, then a mean value formed from the chord length is taken into consideration).

In one preferred embodiment, the leading edge of the thin deflecting blade is displaced axially downstream with respect to that of the thick blade. Preferred is a displacement by at least 0.4, 0.5, or 0.6 times the axial length of the first surrounding-flow structure (thick blade), that is, of the axial fraction of the chord length. Advantageous upper limits lie (also independent thereof) at preferably at most 1.2 times, especially preferred at most 0.9 times, the axial length.

In one preferred embodiment, the thin deflecting blade has a chord length that constitutes at least 1 times, preferably at least 1.5 times, a chord length of the blading of the rotor arranged directly following downstream. If the rotor is equipped with different blades, then, once again, a mean value is taken into consideration. Advantageous upper limits of the chord length of the thin deflecting blade lie at most at 8, 7, 6, 5, 4, or 3 times the chord length of the following rotor, in increasing preference in the order given. Especially preferred, therefore, is a chord length of about 2 to 3 times the axial length.

In one preferred embodiment, the flow arrangement has a third surrounding-flow structure, which is provided as a thin deflecting blade in analogy to the second surrounding-flow structure, but is not identical in construction to the second surrounding-flow structure. The third surrounding-flow structure is arranged on the top side of the thick blade (the thick blade lies on the suction side of the third surrounding-flow structure). At least two different thin deflecting blades are then provided rotationally between two thick blades in each case. The trailing edge of the third surrounding-flow structure is displaced preferably axially downstream with respect to that of the thick blade and is preferably free of axial displacement (not displaced) with respect to that of the second surrounding-flow structure, this preferably also applying to a fourth and, in general, further surrounding-flow structures.

In one preferred embodiment, the third surrounding-flow structure has a shorter chord length than the second surrounding-flow structure. As stated above, more deflection may be required on the bottom side of the first surrounding-flow structure, this being achieved with the longer chord length of the second surrounding-flow structure. If, between two first surrounding-flow structures, more than two different thin deflecting blades are provided rotationally, then they preferably have a decreasing chord length overall from the bottom side of the one thick blade to the top side of the other thick blade. With the varying chord length, it is possible to adjust the free flow cross section in such a way that a uniform flow to the following rotor is achieved.

In one preferred embodiment, the third surrounding-flow structure has a lesser curvature than the second surrounding-flow structure. Therefore, more deflection is achieved with a more strongly curved second surrounding-flow structure on the bottom side of the thick blade (see above). If, between two first surrounding-flow structures, more than two different thin deflecting blades are provided rotationally, then they preferably have a decreasing curvature overall from the bottom side of one thick blade to the top side of the other thick blade.

In one preferred embodiment, another thin deflecting blade is provided (fourth surrounding-flow structure), wherein the second, third, and fourth surrounding-flow structures are not identical in construction to one another. The fourth surrounding-flow structure is arranged on the suction side of the third surrounding-flow structure. Provided that exactly three different thin deflecting blades are arranged rotationally between two thick blades, a fourth surrounding-flow structure is arranged also on the pressure side of the second surrounding-flow structure.

In one preferred embodiment, the fourth surrounding-flow structure has a longer chord length than the third surrounding-flow structure or is more strongly curved, preferably both. Preferably, the chord length and/or the curvature increase or increases from the third surrounding-flow structure via the fourth surrounding-flow structure to the second surrounding-flow structure.

In one preferred embodiment, between two first surrounding-flow structures that are nearest neighbors to each other in the direction of rotation, at least four surrounding-flow structures, each of which are constructed as a deflecting blade, are arranged. Upper limits, which are independent of the lower limits, can be at most twelve, eleven, ten, or nine deflecting blades, increasingly preferred in the named sequence. Especially preferred, there can be exactly four deflecting blades. Between the first surrounding-flow structures that are nearest neighbors to each other, the second, third, fourth, and a fifth surrounding-flow structure can then preferably be arranged; compare also the additionally presented details with the preceding description.

Since, in general, a plurality of deflecting blades are provided between two first surrounding-flow structures, the latter structures can also be displaced by their trailing edges relative to each other; that is, they can be arranged stacked. In relation to the direction of rotation, an equidistant arrangement of the trailing edges of the deflecting blades is also possible in general, but, preferably, the arrangement can be non-equidistant.

In one preferred embodiment, at least the deflecting blades arranged between the two first surrounding-flow structures as nearest neighbors in the direction of rotation are constructed as multiple segments. It is also possible to provide the first surrounding-flow structure as part of the multiple segment. On the other hand, a subdivision may also be advantageous, however, to the extent that only the deflecting blades are combined in multiple segments or else they are formed in a ring, wherein the first surrounding-flow structures are then accordingly combined. Therefore, the first surrounding-flow structure or structures are then cast by themselves; in order to realize the axial overlap, a recess can be introduced—for example, milled—into the trailing edges of the first surrounding-flow structures in each case and the segment or the ring with the deflecting blades is then inserted into the recesses. The surrounding-flow structures of the multiple segment or ring are formed in one piece with one another; that is, they cannot be separated from one another without destruction. Preferably, they are monolithic in construction and, in particular, are formed from one casting.

The invention also relates to a turbomachine having a presently disclosed flow arrangement, which can be placed, in particular, in the mid turbine frame.

The invention also relates to the use of a presently disclosed flow arrangement in a turbomachine, in particular an aircraft engine.

BRIEF DESCRIPTION OF THE FIGURES

The invention will be explained in detail below on the basis of an exemplary embodiment, wherein the individual features in the scope of the independent claims may also be essential to the invention in other combinations, and also no distinction is made in detail between the different claim categories.

Shown in detail are.

DESCRIPTION OF THE INVENTION

Figure 1A:
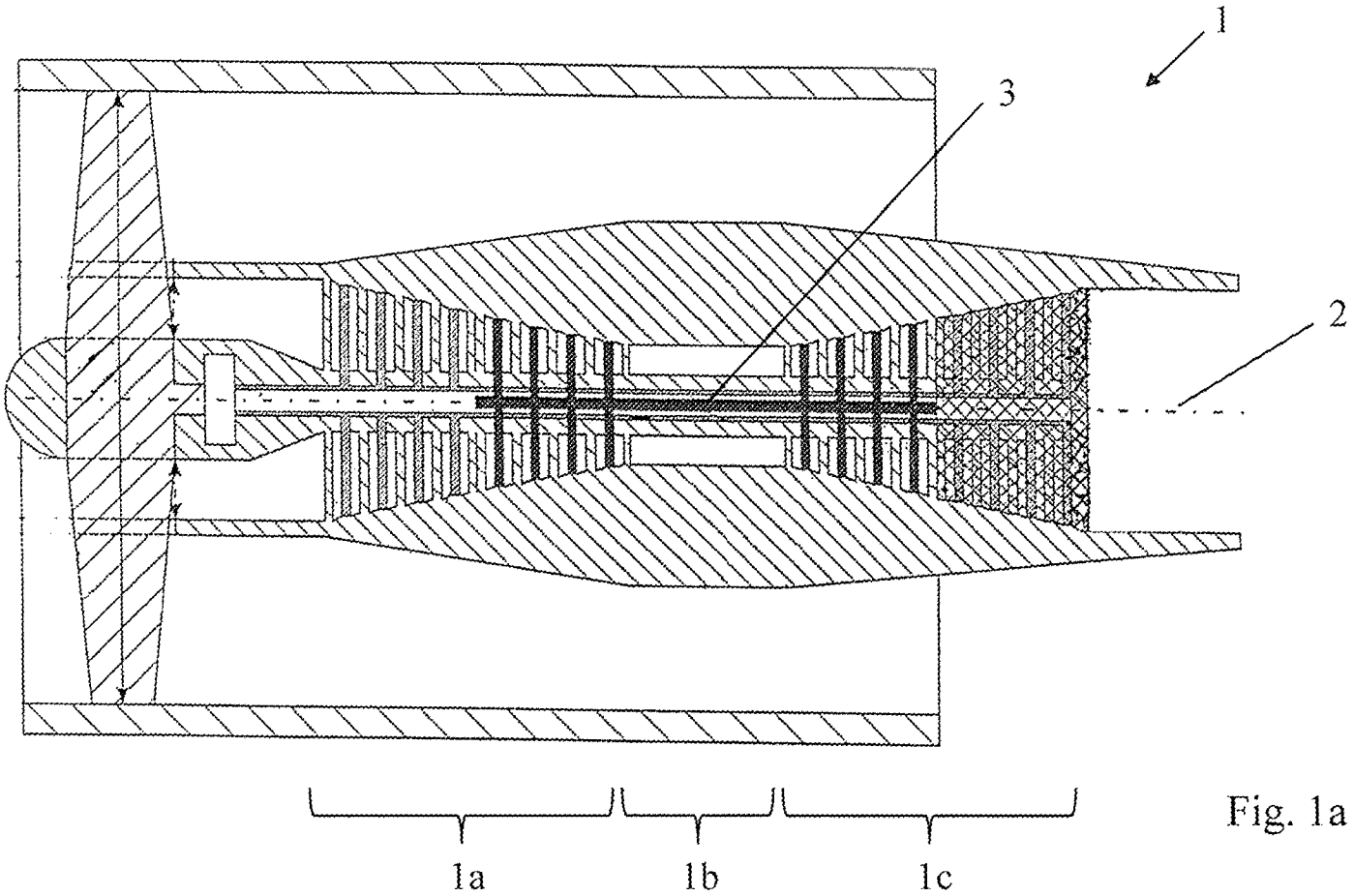
FIG. 1*a* is a jet engine in a section.
Figure 1B:
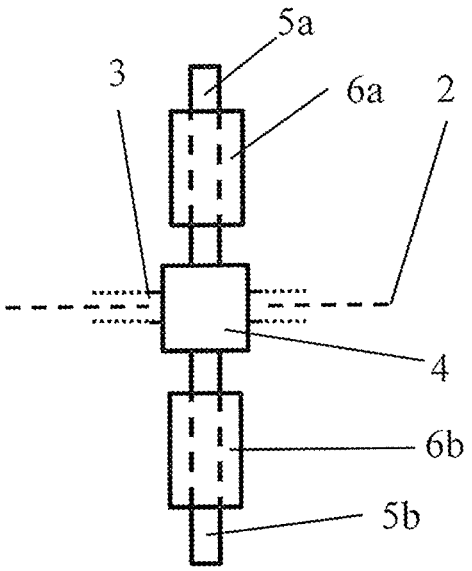
FIG. 1*b* is a schematic detail view relating to FIG. 1*a;*

FIG. 1*a* shows a turbomachine 1 in section, specifically a jet engine. FIG. 1*b* shows a schematic detailed view thereof. The following comments relate to both figures. In functional terms, the turbomachine 1 is composed of the compressor 1*a*, the combustion chamber 1*b*, and the turbine 1*c*. Both the compressor 1*a* and the turbine 1*c* are each constructed from a plurality of stages and each stage is composed, as a rule, of a guide vane ring and a ring of rotating blades. During operation, the ring of rotating blades rotates around the longitudinal axis 2 of the turbomachine 1. The turbomachine shaft 3 is guided in a bearing 4, which is held by support struts 5 (shown partly by dashes) in the rest of the turbomachine 1. In the region of the hot gas duct, each of the support struts 5 is clad for aerodynamic and also thermal reasons, namely, by a first surrounding-flow structure 6, which represents a cladding and is also referred to as a fairing. This segment is a so-called mid turbine frame. In the turbomachine according to the invention, the segment is constructed integrally with the following guide vane ring.

Figure 2:
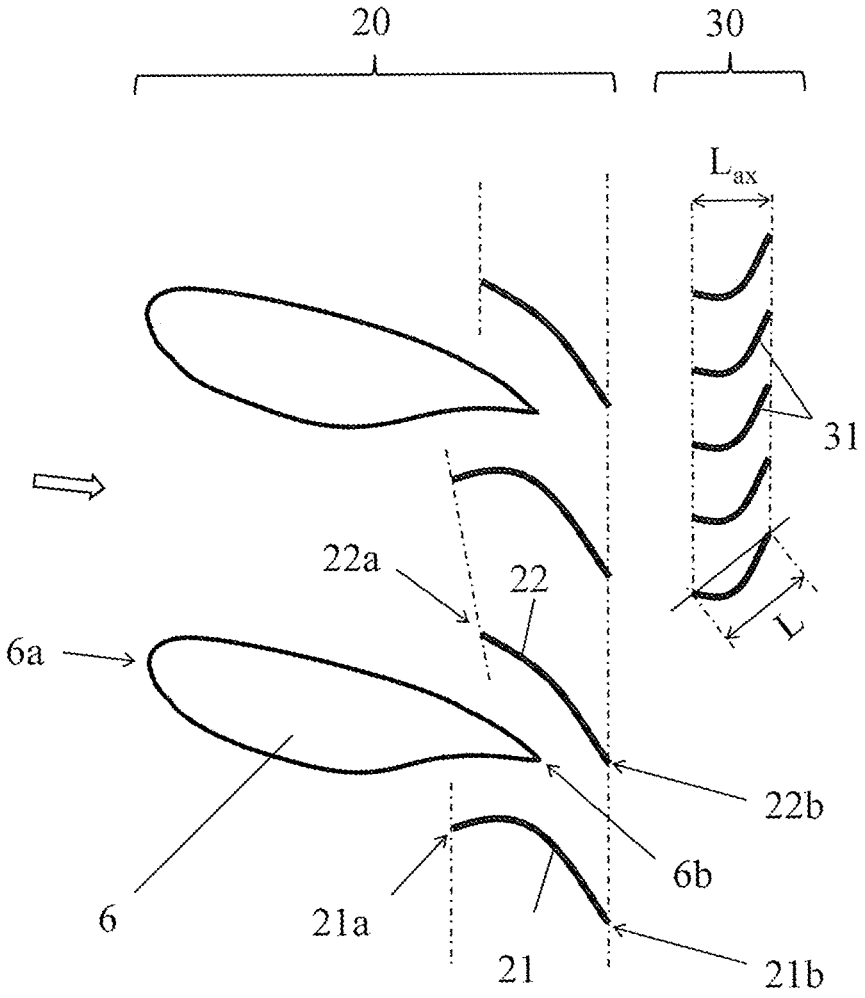
FIG. 2 shows a flow arrangement according to the invention in a mid turbine frame of the jet engine in accordance with FIG. 1*a*.

FIG. 2 shows a part of the flow arrangement 20 according to the invention, which is arranged in the mid turbine frame in the hot gas duct. Shown is a section, where the sectional surface lies radially in the middle of the hot gas duct and is parallel to the longitudinal axis 2. In addition to the first surrounding-flow structures 6 (fairings), two second surrounding-flow structures 21 and third surrounding-flow structures 22 can be seen, each of which is designed as a deflecting blade with a suction side (at the top in the figure) and a pressure side (at the bottom in the figure). The profile thickness of the thin deflecting blades is only about 30% of the profile thickness of the first surrounding-flow structures 6 (in the schematic illustration in accordance with FIG. 2, the thin deflecting blades are depicted for simplicity as lines without a profile thickness).

The surrounding-flow structures 6, 21, 22 each have a leading edge 6*a*, 21*a*, 22*a* and, downstream thereof, a respective trailing edge 6*b*, 21*b*, 22*b*. Although the thin deflecting blades are provided axially with an overlap with respect to the first surrounding-flow structures 6, they are also displaced further to a certain extent. The trailing edges 21*b*, 22*b* of the second and third surrounding-flow structures 21, 22 are displaced axially downstream with respect to the trailing edges 6*b* of the first surrounding-flow structures 6. In addition, the second surrounding-flow structure 21 has its greatest curvature in the region of the axial overlap with the first surrounding-flow structure 6. As a result, a stronger suction is accordingly produced and the flow from the trailing edge 6*b* of the aerodynamically rather unfavorable surrounding-flow structure 6 is accelerated away. The trailing flow is finer and more uniform; compare also what has been presented in the introduction of the description.

On the bottom side of the first surrounding-flow structure 6 (on the bottom in the figure), the flow has to be deflected more strongly than on the top side, because the bottom lateral surface extends essentially axially into the trailing edge 6*b* as a consequence of the larger wedge angle or the greater thickness. For this reason, the second surrounding-flow structure 21 is more strongly curved than the third surrounding-flow structure 22 and it has a longer chord length. The first surrounding-flow structure 6 is arranged on the pressure side of the third surrounding-flow structure 22;

the flow at the trailing edge 6*b* is thereby forced further downward to a certain extent and thus the load on the trailing edge 6*b* is relieved.

Figure 3:
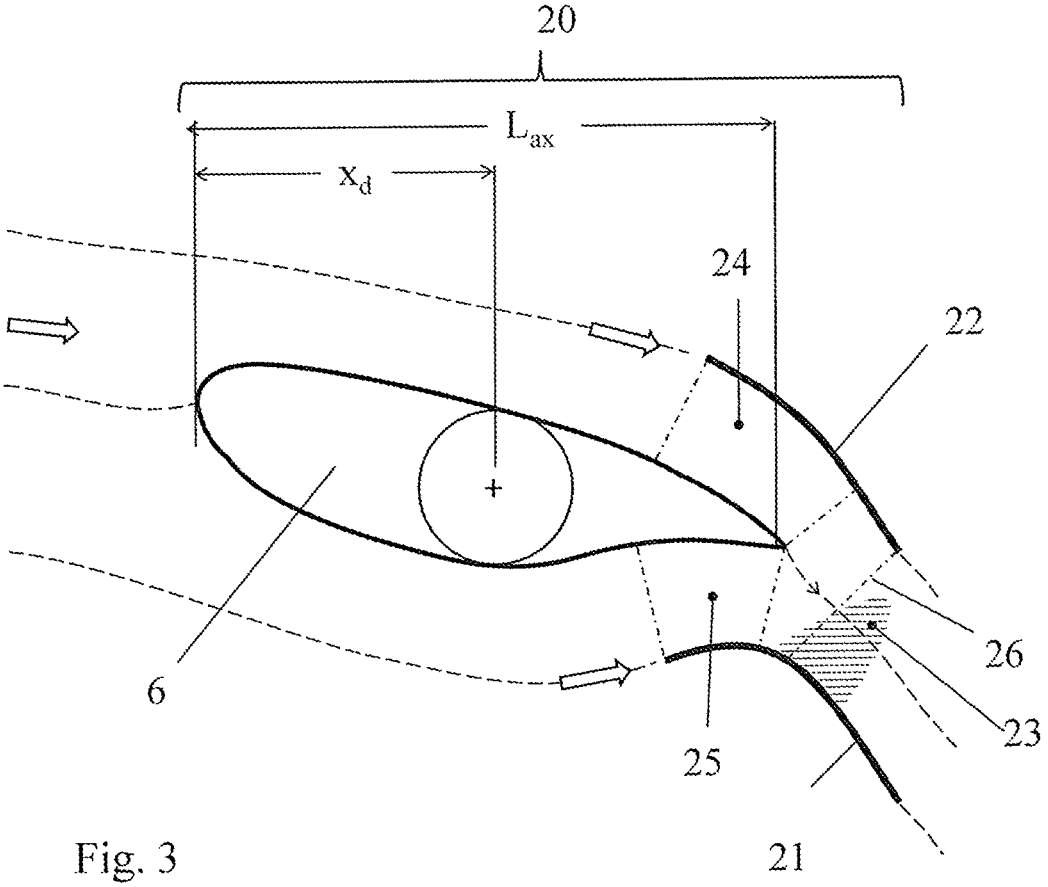
FIG. 3 shows the position of the subchannels with acceleration (nozzle) as well as the suction field of the deflecting blades.

FIG. 3 shows an enlarged illustration of the configuration from FIG. 2 with the suction field 23 on the top side of the thin deflecting blade 21. The two deflecting blades 21, 22, together with the surrounding-flow structure 6, form narrowing flow channels 24, 25 in their intake area, which lead to a further load relief of the flow at the trailing edge 6*b*. Downstream of the trailing edge 6*b*, another narrowing flow channel is adjoined up to the narrowed distance 26 and this produces, together with the blade curvature, the suction field. Thus, surrounding-flow structures 6 with a greater thickness and position of maximum thickness $x_d/L>50\%$ become possible and can accommodate more and larger supply lines and support elements. A reduction in the number of blades, frictional loss, and weight is possible.

In this example, the flow arrangement 20 is overall (over the entire rotation) composed of 9 first, second, and third surrounding-flow structures 6, 21, 22 in each case and therefore has 18 thin deflecting blades. In addition, it is also possible to provide a fourth surrounding-flow structure, which is likewise designed as a thin deflecting blade, so that, therefore, between two first surrounding-flow structures 6, three different thin deflecting blades would be arranged in each case (in this case, a total of 27 thin deflecting blades would be provided); compare also the description in the introduction. Regardless thereof in detail, a groupwise combination of the surrounding-flow structures 6, 21, 22 in multiple segments is preferred. In this regard, the axial displacement can be advantageous in terms of production engineering or, conversely, it would consequently be substantially more complicated to achieve the same flow guidance at the trailing edge 6*b* of the first surrounding-flow structure 6 by way of a first surrounding-flow structure 6 elongated to the rear.

The axial displacement between the trailing edges 21*b*, 22*b* of the second and third surrounding-flow structures 21, 22 with respect to the trailing edges 6*b* of the first surrounding-flow structures 6 corresponds to about 1.5 axial lengths of a following rotor 30, specifically the blading 31 thereof. The described refinement of the flow and making it more uniform is also of advantageous for the operation of the rotor 30.

Although the present invention has been described in detail on the basis of the exemplary embodiments, it is obvious to the person skilled in the art that the invention is not limited to these exemplary embodiments, but rather that modifications are possible in such a way that individual features are omitted or other types of combinations of features can be realized, without leaving the scope of protection of the appended claims. In particular, the present disclosure encompasses all combinations of the individual features shown in the different examples of embodiment, so that individual features that are described only in conjunction with one exemplary embodiment can also be used in other exemplary embodiments, or combinations of individual features that are not explicitly shown can also be employed.

What is claimed is:

1. A flow arrangement fora hot gas duct of a turbomachine, comprising:

a first surrounding-flow structure;

a second surrounding-flow structure;

the first surrounding-flow structure and the second surrounding-flow structure each having, in reference to a surrounding flow in the hot gas duct, a leading edge and, downstream thereof, a trailing edge;

wherein the second surrounding-flow structure is configured and arranged as a deflecting blade with a suction side and a pressure side and has a lesser profile thickness than the first surrounding-flow structure, the first surrounding-flow structure is arranged on the suction side of the second surrounding-flow structure;

wherein, the second surrounding-flow structure has a partial axial overlap with the first surrounding-flow structure with respect to a longitudinal axis of the turbomachine, the trailing edge of the second surrounding-flow structure is displaced axially downstream relative to the trailing edge of the first surrounding-flow structure, and wherein the trailing edge of the second surrounding-flow structure is displaced axially downstream relative to the trailing edge of the first surrounding-flow structure by at least 0.5 times and at most 4.0 times an axial length of a blading of a rotor that is arranged directly downstream of the second surrounding-flow structure.

2. The flow arrangement according to claim 1, in which the first surrounding-flow structure is configured and arranged as a support strut or cladding or fairing thereof.

3. The flow arrangement according to claim 1, wherein the second surrounding-flow structure has a maximum curvature at a place where the second surrounding-flow structure has axial overlap with the first surrounding-flow structure.

4. The flow arrangement according to claim 1, wherein the leading edge of the second surrounding-flow structure is displaced axially downstream relative to the leading edge of the first surrounding-flow structure, namely, by at least 0.4 times and at most 1.2 times an axial length of the first surrounding-flow structure.

5. The flow arrangement according to claim 1, wherein the second surrounding-flow structure has a chord length that constitutes at least 1 times and at most 8 times a chord length of the blading of the rotor that is arranged directly downstream of the second surrounding-flow structure.

6. The flow arrangement according to claim 1, further comprising a third surrounding-flow structure, which is provided as a deflecting blade with a suction side and a pressure side and has a lesser profile thickness than the first surrounding-flow structure, and the second surrounding-flow structure and the third surrounding-flow structure are hereby differently formed, wherein the first surrounding-flow structure is configured and arranged on the pressure side of the third surrounding-flow structure.

7. The flow arrangement according to claim 6, wherein the third surrounding-flow structure has a shorter chord length than the second surrounding-flow structure.

8. The flow arrangement according to claim 6, wherein the third surrounding-flow structure has a lesser curvature than the second surrounding-flow structure.

9. The flow arrangement according to claim 1, wherein the flow arrangement includes a plurality of adjacent first surrounding-flow structures, and wherein, between two nearest of the plurality of adjacent first surrounding-flow structures, in a direction of rotation, at least two additional surrounding-flow structures are each provided as a deflecting blade with a suction side and a pressure side and are each arranged in a peripheral direction.

10. The flow arrangement according to claim 1, wherein the flow arrangement is configured and arranged in a mid turbine frame.

11. The flow arrangement according to claim 1, wherein the flow arrangement is configured and arranged for use in an aircraft engine.

* * * * *